United States Patent [19]

Stevenson

[11] Patent Number: 4,813,367

[45] Date of Patent: Mar. 21, 1989

[54] DIVER'S SLED

[76] Inventor: Michael Stevenson, 107 - 8210 Montcalm Street, Vancouver, British Columbia, Canada, V6P 4R2

[21] Appl. No.: 50,851

[22] Filed: May 18, 1987

[51] Int. Cl.[4] ..... B63E 8/00
[52] U.S. Cl. ..... 114/315
[58] Field of Search ..... 405/186; 114/315, 245

[56] References Cited

U.S. PATENT DOCUMENTS

| | | | |
|---|---|---|---|
| 3,084,654 | 4/1963 | Rosenberg et al. | 114/315 |
| 3,570,436 | 3/1971 | Vasseur | 114/315 |
| 3,757,721 | 9/1973 | Ohishi | 114/315 |

FOREIGN PATENT DOCUMENTS

| | | | |
|---|---|---|---|
| 897816 | 11/1953 | Fed. Rep. of Germany | 114/315 |

*Primary Examiner*—Sherman D. Basinger
*Attorney, Agent, or Firm*—Fetherstonhaugh & Co.

[57] ABSTRACT

An underwater sled to carry a diver and including a motor and propeller, driven by the motor, to propel the sled. There is a body extending forwardly from the propeller. A rotatable joint in the body allows relative rotation of the forward and aft ends of the body. A side member extends outwardly from each side of the forward end of the body. A foil is rotatably mounted on each side member and the diver can control rotation of the body and of each foil.

7 Claims, 1 Drawing Sheet

DIVER'S SLED

FIELD OF THE INVENTION

This invention relates to an underwater sled.

DESCRIPTION OF THE PRIOR ART

In diving, particularly using scuba equipment with oxygen tanks, it is common, especially with professional divers, to have small sleds that tow the diver underwater. The sleds allow the diver to move with relative ease underwater either to reach a destination or to carrying out a survey. These sleds are clearly desirable as a means of saving energy for the diver.

The most popular existing sled simply comprises a battery-operated motor driving a propeller. The propeller is mounted in a shroud, caged at each end, and the shroud has handles sticking outwardly from it. The diver grasps these handles and is towed along. The sled may be equipped with a light or the like.

The sleds are quite difficult to control and a marked disadvantage is that the propeller forces the water against the diver, often into the diver's face. This obscures visibility, especially when the diver is working close to the bottom and the propeller may disturb the sand, mud and the like on the bottom, thus obscuring visibility.

There have been various attempts to improve on this prior art but these attempts have not achieved commercial success.

Prior art known to applicant includes U.S. Pat. Nos. 2,929,346 to Perce; 2,918,889 to Rebikoff; and 3,548,771 to Hastings and British Patent No. 1,144,305.

Of the above patents Perce discloses an underwater boat for one person with a control stick that, through cables, controls movement of the fins. The fins are moved in two directions. The British patent discloses a handlebar and a fin arrangement mounted towards the front end of the tube with limited control of fins. There is a handwheel operated rudder.

Rebikoff is similar to the British patent. Steering of the Rebikoff device is by the rear fin operated by the feet of the diver.

Hastings has the disadvantage of complication. There is a belt system to achieve movement of the fins although the diver must also use his fins to steer the device in Hastings.

SUMMARY OF THE INVENTION

The present invention provides a device of great simplicity, ease of control and also a device in which the diver is positioned ahead of the propeller so that visibility while using the device is not impaired.

Accordingly the present invention provides an underwater sled to carry a diver and including a motor and propeller, driven by the motor, to propel the sled the improvement comprising a body extending forwardly from the propeller; a rotatable joint in the body to allow relative rotation of the forward and aft ends of the body; a side member extending outwardly from each side of the forward end of the body; a foil rotatably mounted on each side member; means to allow a diver to control rotation of the body and of each foil.

DRAWINGS

Aspects of the invention are illustrated, merely by way of example, in the accompanying drawings in which.

DESCRIPTION OF THE PREFERRED EMBODIMENTS

Figure 1:
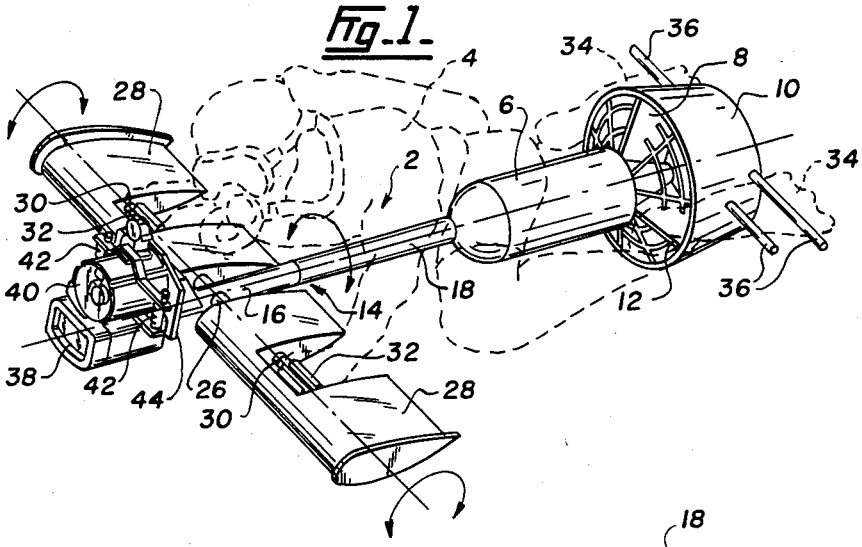
FIG. 1 is a perspective view of a sled according to the present invention.

The drawings show an underwater sled 2 to carry a diver 4, the diver being shown in dashed lines in FIG. 1. As is conventional the sled includes a motor (not shown) typically an electric motor in a water-proof casing 6 that includes a battery. There is a propeller 8, driven by the motor. The propeller propels the sled through the water. Again as is conventional the propeller 8 is provided with a shroud 10 and with cage members 12—only cage 12 at the forward end of the shroud 10 is shown—to prevent fouling of the propeller 8 and, of course, to prevent the propeller 8 contacting the diver 4.

Figure 2:
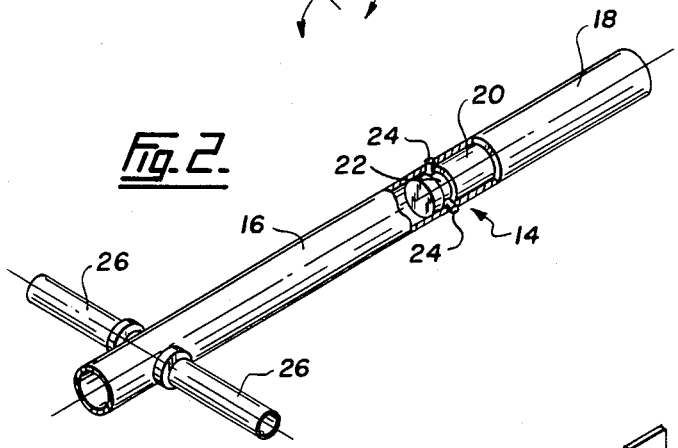
FIG. 2 is a detail of the sled of FIG. 1.

There is a body extending forwardly from the propeller 8. The body, which is simply an elongated tube in the illustrated embodiments, includes a rotatable joint 14 to allow relative rotation of the forward end 16 of the body and the aft end 18 of the body. There are very large numbers of rotatable joints that are appropriate, as will be immediately apparent to the skilled man, but FIG. 2 illustrates a system in which the aft end 18 of the body telescopes into the forward end 16 of the body by the provision of a narrowed portion 20. The portion 20 is formed with a channel 22 at its forward end. The forward end 16 of the body is provided with threaded openings that receive studs 24. Theses studs engage in the channel 22 to retain the two parts 16 and 18 of the body together and yet to allow relative rotation of parts 16 and 18.

There is a side member 26 extending outwardly from each side of the forward end 16 of the body. In FIG. 1 foil 28 is rotatably mounted on each side member 26. In FIG. 1 the side members 26 are a bearing fit within a tube 30 mounted in the foil 28. The tube 30 is provided with handles 32, desirably provided with a roughened area to facilitate grip. Means are provided, for example as in FIG. 2, to ensure that although the foils 28 can rotate on each side member they will not come off the side member, without deliberate activity to release the foils 28 being taken.

These handles 32, rigidly fixed to each foil 28, thus provide a means to allow a diver to control rotation of the body about the joint and also rotation of each foil about the side members.

The sled desirably include means to support fins 34 worn by the diver as such fins can be advantage in facilitating control of the device. In the embodiment of FIG. 1 the diver simply places the fins 34 between bars 36 mounted on the shroud 10.

The device is desirably provided with means to carry equipment at the bow. For example a light 38 may be mounted and an underwater camera 40. Handles 42 are provided to control the direction of these devices. An instrument panel 4 is also desirable. Such a panel will have instruments conventional for a diver, for example a depth gauge, speedometer, clock and an indication of the power available in the battery.

To use the device according to the present invention, as shown in FIGS. 1 and 2, the diver positions himself as shown in FIG. 1. The engine compartment can act as a seat but an additional seat can be provided. With the motor running the diver in effect "flies" through the water using the foils 28 to bank, dive and climb. The bars 36, facilitate the diver remaining on the sled but also allow him to use his fins 34 to assist in steering the sled.

The motor typically uses two or more 12 volt suspended electrolyte batteries and a direct drive, barium ferrite type permanent magnet motor.

In steering the rotation of the foil on a transverse axis gives control over pitch. Rotation about the longitudinal axis of the body gives control over roll.

Figure 3:
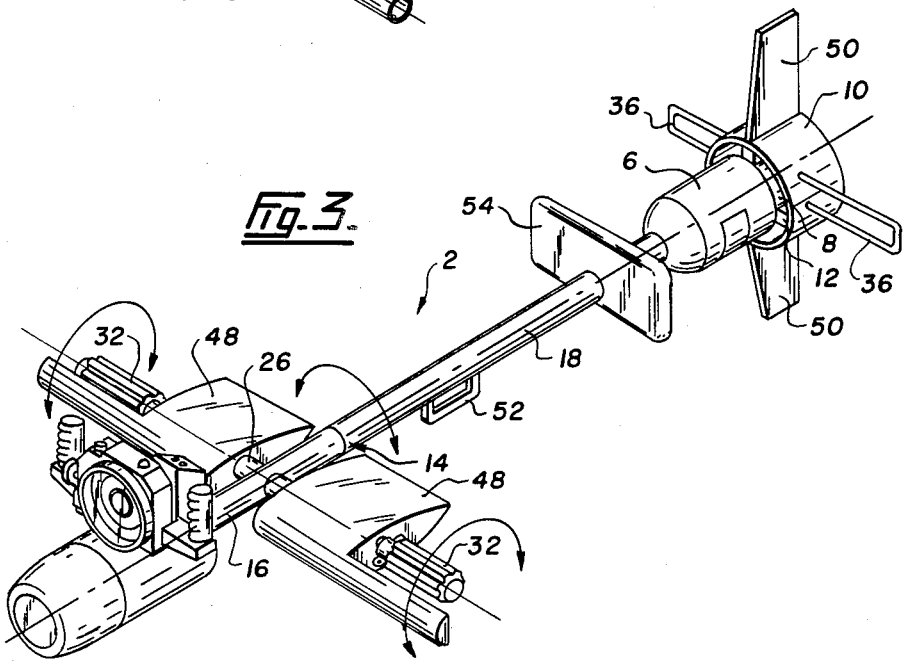
FIG. 3 shows a further embodiment of the invention.

The embodiment of FIG. 3 differs from that of FIG. 1 only in detail. Foils 48 are shorter. Furthermore the embodiment of FIG. 3 is provided with fins 50, to stabilize straight line travel. A handle 52 may be used to manouvre the device on land. The device of FIG. 3 also show the use of a seat or abutment 54 to facilitate the diver's location on the device.

A fairing may be provided to help movement through the water by reducing resistance.

The present invention thus provides a substantial improvement over prior art sleds for divers.

I claim:

1. In an underwater sled to carry a diver and including a motor and propeller, driven by the motor, to propel the sled the improvement comprising:

a body having a forward and aft end with a longitudinal axis, said propeller being located at said aft end and said body extending forwardly from said propeller;

a rotatable joint in the body to allow free rotation between the forward and aft ends of the body about the body's longitudinal axis so as to allow the diver to control the roll of the sled in steering of the sled;

a side member extending outwardly from each side of the forward end of the body;

a foil rotatably mounted on each side member;

means to allow a diver to control rotation of the body and each foil.

2. A sled as claimed in claim 1 in which the body is an elongated tube with the rotatable joint towards its forward end.

3. A sled as claimed in claim 1 in which the means to allow a diver to control rotation of the body comprises a handle on each foil to allow rotation of the foils and of the body by hand.

4. A sled as claimed in claim 1 including means to support foot fins worn by the diver to assist in control of the sled.

5. A sled as claimed in claim 4 in which the propeller has a shroud and in which there are bars mounted on the shroud as a means to support the foot fins.

6. A sled as claimed in claim 1 adapted to carry equipment at the bow.

7. A sled as claimed in claim 1 including an instrument panel.

* * * * *